US005124022A

United States Patent [19]

Evans, II et al.

[11] Patent Number: 5,124,022

[45] Date of Patent: * Jun. 23, 1992

[54] ELECTROLYTIC CAPACITOR AND METHOD OF MAKING SAME

[75] Inventors: W. Thomas Evans, II, Indiana; Ford J. Simpson, Jr., Apollo; Larry F. Wieserman, Apollo, all of Pa.

[73] Assignee: Aluminum Company of America, Pittsburgh, Pa.

[ * ] Notice: The portion of the term of this patent subsequent to Jul. 16, 2008 has been disclaimed.

[21] Appl. No.: 596,019

[22] Filed: Oct. 11, 1990

Related U.S. Application Data

[63] Continuation-in-part of Ser. No. 397,281, Aug. 23, 1989, Pat. No. 5,032,237.

[51] Int. Cl.[5] ..... C25D 11/34; C25D 9/02

[52] U.S. Cl. ..... 205/175; 361/502; 361/524

[58] Field of Search ..... 204/38.3, 56.1, 42, 204/58; 361/500, 502, 524; 148/241, 281, 33, DIG. 14; 29/25.03; 282/62.8

[56] References Cited

U.S. PATENT DOCUMENTS

| | | | |
|---|---|---|---|
| 4,113,579 | 9/1978 | Randall et al. | 204/33 |
| 4,164,779 | 8/1979 | Laver et al. | 361/433 |
| 4,180,442 | 12/1979 | Byrd | 204/14 N |
| 4,204,919 | 5/1980 | Randall et al. | 204/29 |
| 4,279,715 | 7/1981 | Arora et al. | 204/129.9 |
| 4,381,226 | 4/1983 | Gillich et al. | 204/14 N |
| 4,383,897 | 5/1983 | Gillich et al. | 204/33 |
| 4,388,156 | 6/1983 | Gillich et al. | 204/14 N |
| 4,399,021 | 8/1983 | Gillich et al. | 204/38 A |
| 4,427,506 | 1/1984 | Nguyen et al. | 204/129.4 |
| 4,432,846 | 8/1984 | Honeycutt, III | 204/129.95 |
| 4,448,647 | 5/1984 | Gillich et al. | 204/33 |
| 4,470,885 | 9/1984 | Randall et al. | 204/29 |
| 4,479,167 | 10/1984 | Ross et al. | 361/433 |
| 4,537,665 | 8/1985 | Nguyen et al. | 204/29 |
| 4,580,194 | 4/1986 | Finkelstein et al. | 361/433 |
| 4,681,668 | 7/1987 | Davies et al. | 204/28 |
| 4,788,176 | 11/1988 | Wieserman et al. | 502/401 |

FOREIGN PATENT DOCUMENTS

| | | |
|---|---|---|
| 0246825 | 11/1987 | European Pat. Off. . |
| 0264972 | 4/1988 | European Pat. Off. . |
| 62-134920 | 6/1987 | Japan . |
| 63-146424 | 6/1988 | Japan . |

*Primary Examiner*—John F. Niebling
*Assistant Examiner*—Kathryn Gorgos
*Attorney, Agent, or Firm*—Andrew Alexander

[57] ABSTRACT

An improved valve metal electrolytic capacitor is disclosed, such as an aluminum electrolytic capacitor, as well as a method of making same wherein the improvement comprises forming a hydration resistant composite layer on the valve metal, including a valve metal oxide dielectric layer, by anodizing the valve metal in an aqueous phosphorus-containing organic electrolyte selected from the class consisting of phosphonic acid, phosphinic acid and mixtures of the same dissolved in an aqueous liquid to provide an electrolytic capacitor with increased resistance to hydration.

23 Claims, 3 Drawing Sheets

DISSOLUTION IN $H_3PO_4-CrO_3$, 85°C

ELECTROLYTIC CAPACITOR AND METHOD OF MAKING SAME

CROSS REFERENCE TO RELATED APPLICATIONS

This application is a continuation-in-part of U.S. Ser. No. 397,281, filed Aug. 23, 1989.

BACKGROUND OF THE INVENTION

1. Field of the Invention

This invention relates to an improved electrolytic capacitor and a method of forming the same. More particularly, this invention relates to an improved low voltage electrolytic capacitor having a barrier oxide layer with improved resistance to hydration formed by anodizing a valve metal, without prior formation of a thermal oxide layer thereon, in an aqueous phosphorus-containing organic acid electrolyte selected from the class consisting of monomeric phosphonic acid molecules, monomeric phosphinic acid molecules and mixtures of the same dissolved in an aqueous liquid. 2. Description of the Related Art It is known to form electrolytic capacitors such as aluminum electrolytic capacitors by anodizing aluminum foil in a phosphoric acid electrolyte or a phosphate electrolyte, e.g., ammonium dihydrogen phosphate. For example, U.S. Pat. Nos. 4,164,779; 4,279,715; 4,427,506; 4,432,846; 4,479,167; and the English abstracts of Japanese Patent documents 62-134920 and 63-146424 all describe the use of phosphoric acid in the manufacture of aluminum electrolytic capacitors; while U.S. Pat. Nos. 4,113,579; 4,204,919; 4,470,885; 4,537,665; 4,580,194; and the English abstract of Japanese Patent document 63-146424 all describe the use of a phosphate such as for example, ammonium dihydrogen phosphate, in the formation of aluminum electrolytic capacitors. European Patent Application 246,825 describes an electrolytic solution for an aluminum electrolytic capacitor comprising a quaternary phosphonium salt. The English Abstract of European Patent Document 264,972 indicates that it teaches a method for cleaning aluminum surfaces by anodizing the aluminum in phosphoric acid to form surface oxide which is then dissolved as it forms.

It is also known to anodically form coatings on the surfaces of metals such as aluminum, using electrolytes including phosphonic acids, to enhance adhesive, bonding and/or spot welding to the metal surface; to enhance corrosion resistance, for example, for architectural application; and for lithographic applications. Such teachings may be typically found, for example, in U.S. Pat. Nos. 4,180,442; 4,381,126; 4,383,897; 4,399,021; 4,448,647; 4,788,176; 4,681,668; and European Patent Application 246,825.

U.S. Pat. No. 4,388,156 describes electrochemical treatment of aluminum substrates in a non-aqueous solution of a polybasic organic acid, such as sulfonic acids, phosphonic acids, phosphoric acids, or tribasic carboxylic acids, in an organic solvent, such as formamide, dimethylsulfoxide, aniline, dimethylformamide, mono-, di-, tri-ethanol amine, and tetrahydrofuran. The treated aluminum substrate is said to be provided with a surface which has improved adhesion to subsequently applied coatings which are useful for photographic elements in lithography or for capacitors and dielectric applications where a barrier layer is useful.

Conventionally, before such oxide dielectric layers are anodically formed on the valve metal surface, particularly in the formation of aluminum electrolytic capacitors, the aluminum metal is thermally oxidized by heating the metal to form a thermal oxide layer, and the subsequent anodically formed barrier oxide layer then forms beneath the thermal oxide layer. This two-step oxide formation process has been necessary to provide an oxide layer having the electrical properties needed to serve as the dielectric layer of the capacitor.

It would, however, be desirable to form an electrolytic capacitor by anodizing an electrolytic valve metal surface, such as an aluminum foil surface, using an electrolyte which forms a barrier oxide dielectric layer having increased resistance to hydration, and comparable capacitance values to prior art electrolytic capacitors, while eliminating the need for the prior art step of forming a thermal oxide layer on the valve metal surface before anodizing the metal surface.

SUMMARY OF THE INVENTION

It is, therefore, an object of this invention to provide an improved electrolytic capacitor wherein the improvement comprises a hydration resistant composite layer formed on a valve metal such as aluminum, tantalum or niobium by contact with an aqueous phosphorus-containing organic acid electrolyte selected from the class consisting of phosphonic acid, phosphinic acid and mixtures of the same dissolved in an aqueous liquid.

It is another object of this invention to provide an improved electrolytic capacitor wherein the improvement comprises a hydration resistant composite layer, including a metal oxide dielectric layer, formed by contacting a valve metal with an aqueous phosphorus-containing organic acid electrolyte selected from the class consisting of phosphonic acid, phosphinic acid and mixtures of the same dissolved in an aqueous liquid.

It is yet another object of this invention to provide an improved electrolytic capacitor wherein the improvement comprises a hydration resistant composite layer, including a metal dielectric oxide layer, formed by anodizing a valve metal in an aqueous phosphorus-containing organic acid electrolyte selected from the class consisting of phosphonic acid, phosphinic acid and mixtures of the same dissolved in an aqueous liquid.

It is still another object of this invention to provide an improved electrolytic capacitor wherein the improvement comprises a hydration resistant composite layer, including a metal oxide dielectric layer, the composite layer formed by anodizing a valve metal in an aqueous phosphorus-containing organic acid electrolyte selected from the class consisting of phosphonic acid, phosphinic acid and mixtures of the same dissolved in an aqueous liquid.

It is a further object of this invention to provide a method of making an improved electrolytic capacitor wherein the improvement comprises forming a hydration resistant composite layer on a valve metal, with or without prior formation of a thermal oxide layer thereon, by contacting the valve metal surface with an aqueous phosphorus-containing organic acid electrolyte selected from the class consisting of phosphonic acid, phosphinic acid and mixtures of the same dissolved in an aqueous liquid.

It is still a further object of this invention to provide a method of making an improved electrolytic capacitor which comprises forming a hydration resistant composite layer on a valve metal, including a metal oxide dielectric layer, without a prior step of forming a thermal oxide layer on the valve metal surface, by anodizing the valve metal in an aqueous phosphorus-containing organic acid electrolyte selected from the class consisting of phosphonic acid, phosphinic acid and mixtures of the same dissolved in an aqueous liquid.

These and other objects of the invention will be apparent from the following description and accompanying drawings.

DETAILED DESCRIPTION OF THE INVENTION

Figure 1:
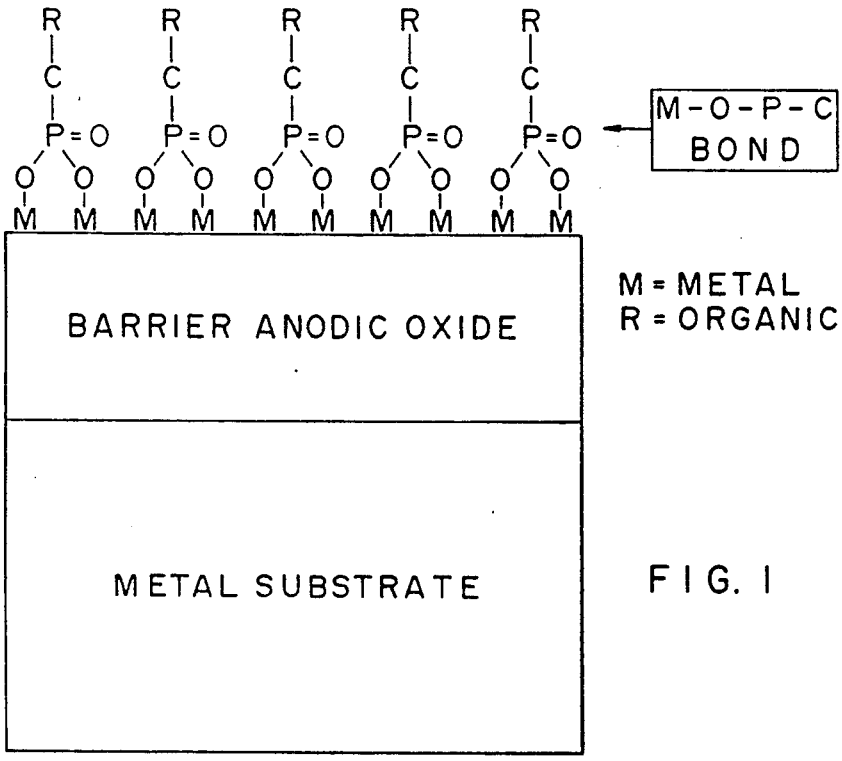
FIG. 1 is a cross-sectional schematic view which illustrates the R groups in the composite layer extending away from the surface of the valve metal.

The invention comprises an improved valve metal electrolytic capacitor, such as an aluminum electrolytic capacitor, and method of making the same. The improvement comprises forming a hydration resistant composite layer on the valve metal, including a valve metal oxide dielectric layer, by anodizing the valve metal. This may be accomplished without a prior step of forming a thermal oxide layer on the valve metal surface. The anodizing can be carried out in an aqueous phosphorus-containing organic acid electrolyte selected from the class consisting of phosphonic acid, phosphinic acid and mixtures of the same dissolved in a aqueous liquid. The electrolytic capacitor formed can have increased resistance to hydration and comparable capacitance to prior art electrolytic capacitors formed at the same voltage via the prior art two-step process. The invention finds particular value when employed in the manufacture of low voltage electrolytic capacitors, i.e., electrolytic capacitors with a rated voltage below 200 volts, or from about 1 to about 500 volts.

The terms "valve metal oxide" and "aluminum oxide", as used herein, are respectively intended to include natural valve metal oxide or natural aluminum oxide, as well as any anodized layer having less than 5% hydroxyl groups and preferably less than 1%.

By increased resistance to hydration is meant a composite layer wherein the capacitance of the layer, after exposure to moisture, does not vary by more than 20%.

The term "aqueous phosphonic acid electrolyte", as used herein, is intended to define an aqueous electrolyte having dissolved therein a water soluble phosphonic acid, either monomeric or polymeric, having the formula $R_m[PO(OH)_2]_n$ wherein R is one or more organic radicals having a total of 1-30 carbons, preferably 1-12 carbons, m is the number of radicals in the molecule ranging from 1-10 and n is the number of phosphonic acid groups in the molecule ranging from 1-10. The electrolyte comprises an aqueous or water solution having a molar concentration of the above water soluble phosphonic acid molecules of from about 0.001 to a saturated solution, and preferably from about 0.1 to about 2 molar. The pH of the electrolyte may range from about 1.0 to about 12, preferably from about 1.5 to about 9.

The term "aqueous phosphinic acid electrolyte", as used herein, is intended to define an electrolyte having dissolved therein a soluble phosphinic acid, either monomeric or polymeric, having the formula $R_mR'_o[PO(OH)]_n$ wherein R comprises one or more organic radicals having a total of 1-30 carbons, m is the number of R radicals in the molecule ranging from 1-10, R' comprises hydrogen or one or more organic radicals having a total of 1-30 carbons, o is the number of R' radicals ranging from 1-10 and n is the number of phosphinic acid groups in the molecule, ranging from 1-10 with the total number of carbons in each phosphinic acid molecule preferably ranging from 1-12. The electrolyte comprises an aqueous or water solution having a molar concentration of the above water soluble phosphinic acid molecules from about 0.001 to a saturated solution, and preferably from about 0.1 to about 2 molar. The pH of the electrolyte may range from about 1.0 to about 12, preferably from about 1.5 to about 9.

Examples of groups which may comprise R and/or R' in the above formulas include long and short chain (1-18 carbon) aliphatic hydrocarbons, aromatic hydrocarbons, carboxylic acids, aldehydes, ketones, amines, amides, thioamides, imides, lactams, anilines, pyridines, piperidines, carbohydrates, esters, lactones, ethers, alkenes, alkynes, alcohols, nitriles, oximes, organosilicones, ureas, thioureas, perfluoro organic groups, methacrylates and combinations of, these groups.

Representative of the monomeric phosphonic/phosphinic acids are as follows: amino trismethylene phosphonic acid, aminobenzylphosphonic acid, phosphomycin, 3-amino propyl phosphonic acid, small O-aminophenyl phosphonic acid, 4-methoxyphenyl phosphonic acid, aminophenylphosphonic acid, aminophosphonobutyric acid, aminopropylphosphonic acid, benzhydrylphosphonic acid, benzylphosphonic acid, butylphosphonic acid, carboxyethylphosphonic acid, diphenylphosphinic acid, dodecylphosphonic acid, ethylidenediphosphonic acid, heptadecylphosphonic acid, methylbenzylphosphonic acid, naphthylmethylphosphonic acid, octadecylphosphonic acid, octylphosphonic acid, pentylphosphonic acid, phenylphosphinic acid, phenylphosphonic acid, phosphonopropionic acid, phthalide-3-phosphonic acid, bis-(eprfluoroheptyl) phosphinic acid, perfluorohexyl phosphonic acid and styrene phosphonic acid.

Representative of the polymeric phosphonic/phosphinic acids are as follows: polyvinyl phosphonic acid, poly(vinylbenzyl)phosphonic acid, poly(2-propene)-phosphonic acid, phosphonomethyl ethers of cellulose, phosphonomethyl ethers of polyvinyl alcohol, poly 2-butene phosphonic acid, poly 3-butene phosphonic acid, phosphonomethyl ethers of starch, polystyrene phosphonic acid, polybutadiene phosphonic acid and polyethylene imine methyl phosphonate.

The term "valve metal" as used herein for the metal surface to be anodized to form an electrolytic capacitor comprises a metal selected from the class consisting of aluminum, tantalum and niobium. The use of such metals is intended to include the use of alloys thereof containing at least 50 wt. % of one or more of the valve metals. When the valve metal comprises a valve metal alloy, the alloy may comprise two or more of the above valve metals alloyed together or it may comprise one or more of the above valve metals alloyed with one or more alloying elements or impurities such as, by way of example and not of limitation, silicon, iron, copper, vanadium, titanium, boron, lithium and zirconium. Preferably, however, to preserve the desired electrical characteristics of the capacitor, the valve metal, or valve metals used will each have a purity of at least about 99 wt. %, and more preferably will each have a purity of at least 99.7 wt. %. In a preferred embodiment, the valve metal comprises aluminum which preferably has a purity of at least about 99.7 wt. %, and most preferably at least about 99.85 wt. %.

The valve metal surface to be treated may be a foil, sheet, plate, extrusion, tube, rod or bar surface and may be planar, curved, or in any other shape which will not interfere with formation of the capacitor. By way of illustration, and not of limitation, the valve metal will be described hereinafter as aluminum.

To anodically form the composite layer on the aluminum surface, the surface should preferably be cleaned to remove any materials which might interfere with the formation of the composite layer thereon. The cleaning may be carried out by contacting the aluminum surface with an acid, for example, a mineral acid such as nitric, hydrochloride, or sulfuric acid, or a base such as sodium hydroxide or, sodium carbonate, followed, in either case, by rinsing the cleaned surface with water.

The aluminum surface is etched prior to the anodization step to increase the surface area as is well known to those skilled in this art. The etch may be performed using halogen salts of alkali metals such as LiCl, NaCl, KCl or CsCl. Alternatively, the aluminum surface may be electrolytically etched. This results in increased surface area of the aluminum.

At this point in the prior art processes for making an electrolytic capacitor, a layer of thermal oxide would now be formed over the aluminum surface prior to the anodization using techniques well known to those skilled in the art of making electrolytic capacitors. However, in accordance with the process of the invention, this thermal oxide formation step may be eliminated without any ascertainable deleterious consequences with respect to the performance of the electrolytic capacitor formed in the process of the invention. However, the thermal oxide layer may be formed first and a layer in accordance with the invention applied afterwards.

The aluminum surface, together with a counter electrode, e.g., a carbon or platinum electrode, is immersed in the aqueous phosphorus-containing organic acid electrolyte selected from the class consisting of monomeric phosphonic acid and monomeric phosphinic acid described above which is maintained at a temperature within a range of from about 5° C. to about 100° C., preferably within a range of from about 20° C. to about 80° C., during the anodization. Maintaining the electrolyte bath temperature at the low end of the range is preferable with respect to the solubilities of either aluminum phosphonate or aluminum phosphinate.

The aluminum is then connected to the positive terminal of a constant voltage power supply. The anodization may be performed using constant current, constant voltage, AC, DC, AC superimposed on DC, DC biased, pulsed DC such as saw tooth, square wave or sine wave or combinations thereof. A formation voltage of from about 1 to 400 volts DC is selected in accordance with the desired capacitance and the aluminum surface is then anodized, while monitoring the current, until the current density drops to a value indicative that the surface has been sufficiently anodized.

Figure 2:
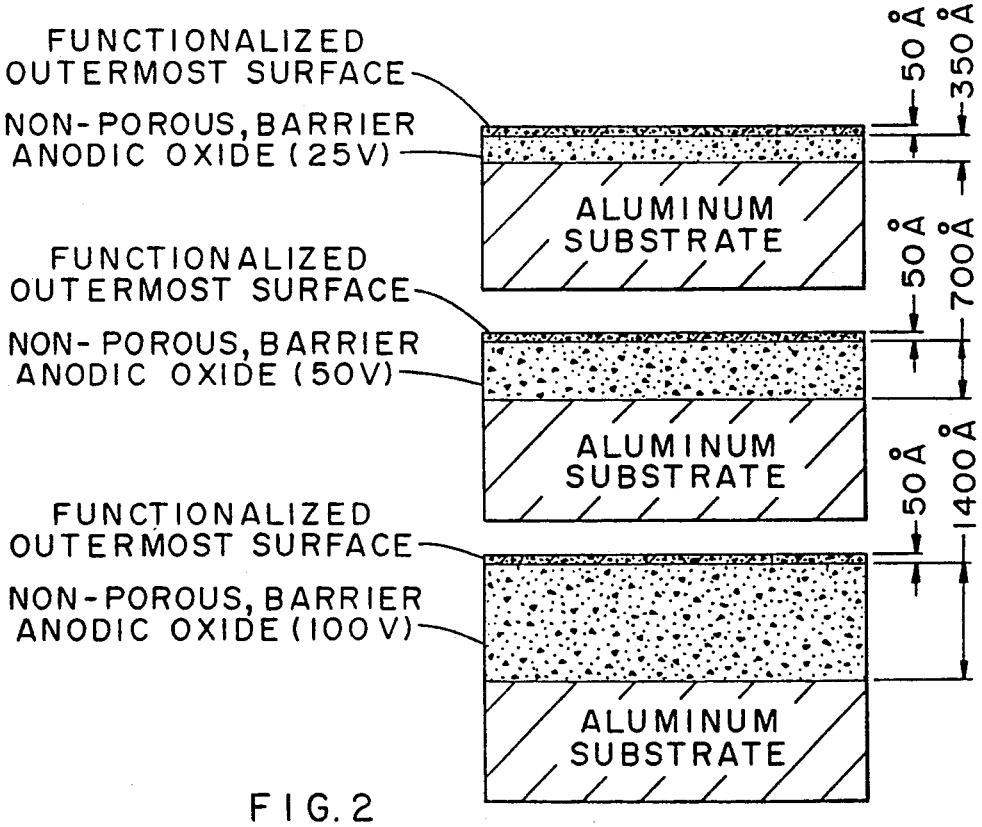
FIG. 2 is a schematic view representing the increase in oxide thickness with voltage and the constant thickness of the functionalized layer thereon.

Normally, anodizing at a pH in the range of 0.1 to 4.5 or 8 to 14 results in dissolution of barrier oxide as it is formed. However, the claimed anodizing process can be carried out at a pH as low as 1.0 without any significant dissolution of the barrier oxide by the anodizing electrolyte. This is accomplished by the presence of the functionalized layer of phosphonic or phosphinic acid which attaches to the surface of the oxide layer on the aluminum, as illustrated in FIGS. 1 and 2. That is, the functionalized layer resists or prevents the electrolyte from dissolving the underlying non-porous barrier-type oxide layer. Thus, the barrier-type oxide layer grows (proportional to the formation voltage) until current passage therethrough approaches zero at a given voltage.

The resulting non-porous oxide layer on aluminum can have a density range from 2.8 to 3.2 gms/cc.

The thickness of the composite layer can range from 15 to 7500 Å and typically in the range of 25 to 3000 Å.

The thickness of the functionalized monomolecular layer of phosphonic/phosphinic acid bonded to the anodically formed aluminum oxide surface is less than 200 Å and usually less than 100 Å, with a typical thickness being in the range of 5 to 30 Å.

The film thickness or oxide layer thickness can be as high as 25 Å/V but preferably is in the range of 12 to 16 Å/V, depending on the alloy, but typically is in the range of 13.8 to 14.2 Å/V for aluminum.

The result is an aluminum surface having a composite layer formed thereon and bonded to the aluminum surface comprising a first layer of anodically formed nonporous dense aluminum oxide and a layer of monomeric phosphonic/phosphinic acid bonded to the aluminum oxide layer.

With respect to the bonding of the phosphonic/phosphinic acid molecule to the aluminum oxide surface, while we do not wish to be bound by any particular theory of bonding, a monolayer of phosphonic/phosphinic acid is formed uniformly on the aluminum surface at the onset of anodization. The phosphonate/phosphinate layer permits the field-driven diffusion of oxygen into the forming oxide barrier film but does not allow access of the liquid to the oxide film. Thus, a nonporous, dense barrier oxide layer is formed beneath the layer of monomeric phosphonate or phosphinate groups. While again, we do not wish to be bound by theories of operation, this initial formation of a phosphonate or phosphinate layer on the aluminum, surface, beneath which phosphonate/phosphinate layer the barrier oxide layer anodically forms, may be the reason why one does not need to precede the process of the invention with a thermal oxide formation step.

Examination of the layers of the subject invention by Electron Spectroscopy for Chemical Analysis (ESCA) shows a high ratio of aluminum to phosphorus. That is, aluminum can be about 6 to 30 times that of phosphorus. For example, the ratio of aluminum to phosphorus when monovinyl phosphonic acid, allylphosphonic acid and phenyl phosphonic acid were used as electrolytes were 24.1/3.0, 27.8/1.6 and 25.6/0.9, respectively. The aluminum to phosphorus ratio can range from 1000 to 1, preferably 50 to 5. See Table I below.

TABLE I

| Atomic Concentrations Determined by ESCA (%) | | | | | |
|---|---|---|---|---|---|
| Sample | Al | O | P | C | Al/P |
| 1 M VPA[1] | 24.1 | 27.1 | 3.0 | 45.8 | 8.0 |
| 1 M APA[2] | 27.8 | 30.8 | 1.6 | 39.8 | 17.2 |
| 1 M PPA[3] | 25.6 | 43.8 | 0.9 | 26.4 | 28.4 |

[1]Monovinyl phosphonic acid
[2]Allylphosphonic acid
[3]Phenyl phosphonic acid

This shows that the acids are not incorporated into the oxide barrier layer but are bonded on the surface of the layer thereby protecting the oxide from dissolution by the electrolyte.

After completion of the step of anodically forming the composite layer on the aluminum surface, the coated aluminum is removed from the bath, rinsed, dried and then further processed conventionally to form an electrolytic aluminum capacitor therefrom using standard practices well known to those skilled in the art of making electrolytic capacitors.

To further illustrate the invention, several samples of aluminum foil, made from CP59 alloy (99.96 wt. % Al) in the H-19 temper, were first cleaned in NaOH solution then etched for 2 minutes in 3400 gms/1 NaCl solution at 80° C. The samples then were anodized at a number of voltages ranging from 30 volts DC to 90 volts DC in a 0.1 molar aqueous phenylphosphonic acid electrolyte at a pH of 1.8. Control samples of the same foil were anodized at the same voltages in a 30 g/l tartaric acid electrolyte, representing the prior art. The results listed in Table II below show that the capacitance of the aluminum foil anodized in phenylphosphonic acid, in accordance with the invention and without a prior thermal oxide layer formed thereon, is comparable to the capacitance of the prior art samples anodized in tartaric acid at various formation voltages ranging from 30 volts to 140 volts and at formation temperatures of 20° C. and 70° C.

TABLE II

| Capacitance of Aluminum Foils At Various Formation Voltages and Temperatures | | | |
|---|---|---|---|
| Sample | Temp °C. | Formation Voltage | Capacitance |
| 1. TAR | 20 | 30 | 611 |
| 2. TAR | 20 | 60 | 217 |
| 3. TAR | 71 | 60 | 250 |
| 4. TAR | 20 | 90 | 106 |
| 5. TAR | 20 | 150 | 60 |
| 6. TAR | 71 | 150 | 51 |
| 7. PPA | 20 | 30 | 623 |
| 8. PPA | 20 | 60 | 263 |
| 9. PPA | 71 | 60 | 234 |
| 10. PPA | 20 | 90 | 132 |
| 11. PPA | 20 | 140 | 51 |

To further illustrate the differences between the composite layer formed in accordance with the invention, comparative oxide dissolution tests were conducted, using foils anodized in phenylphosphonic acid in accordance with the invention, and foils anodized in tartaric acid, representing the prior art. Two foils anodized in tartaric acid respectively at 20° C. and 70° C., and two foils anodized in accordance with the invention in phenylphosphonic acid, respectively at 20° C. and 70° C., and all anodized at 50 volts, were placed in a $H_3PO_4$/-$CrO_3$ solution at 85° C. and the weight loss of each sample was plotted against time.

Figure 3:
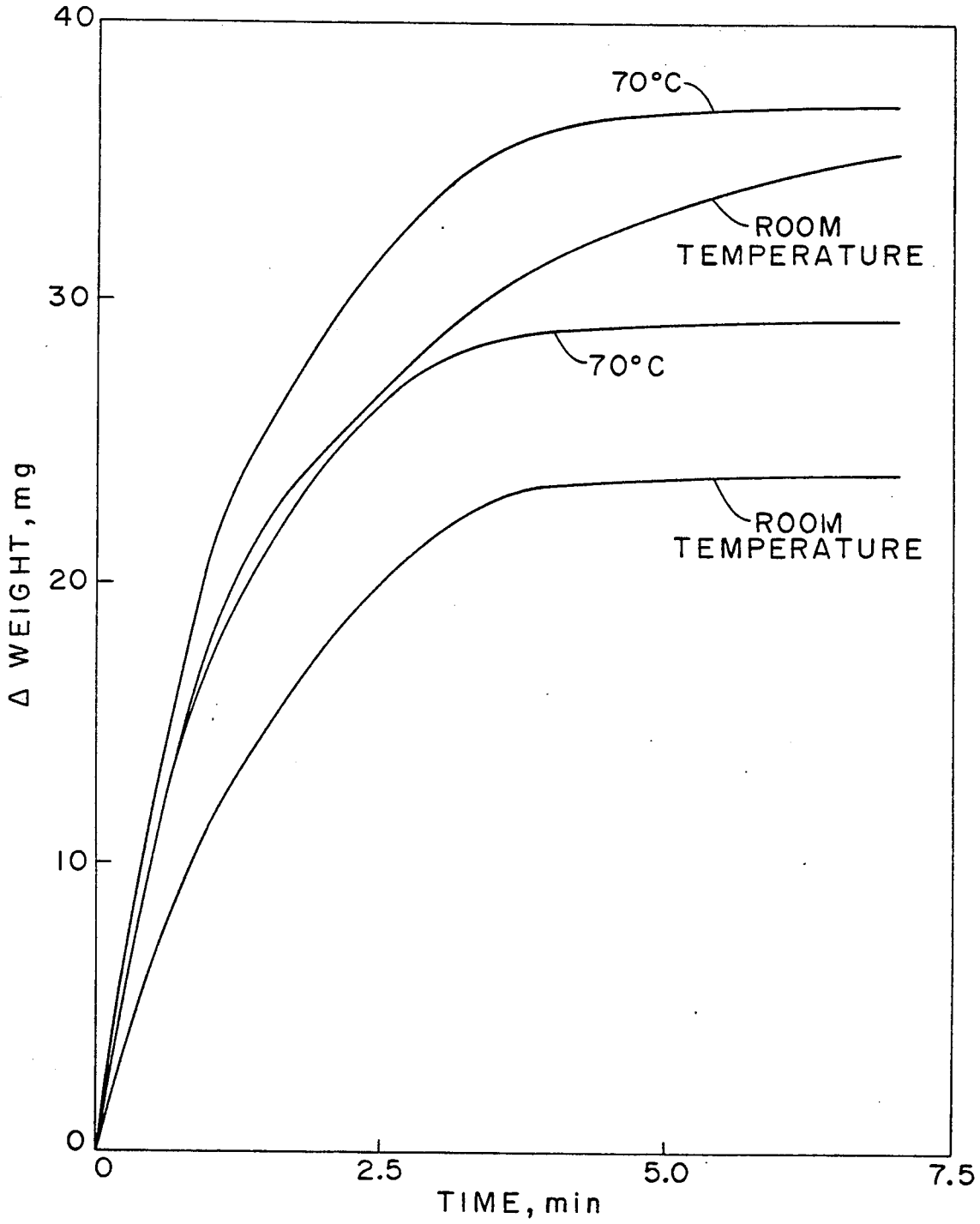
FIG. 3 is a graph showing the comparative dissolution of oxide in a $H_3PO_4/CrO_3$ solution at 85° C. from aluminum surfaces respectively anodized in tartaric acid (representing the prior art) and phenylphosphonic acid.
Figure 4:
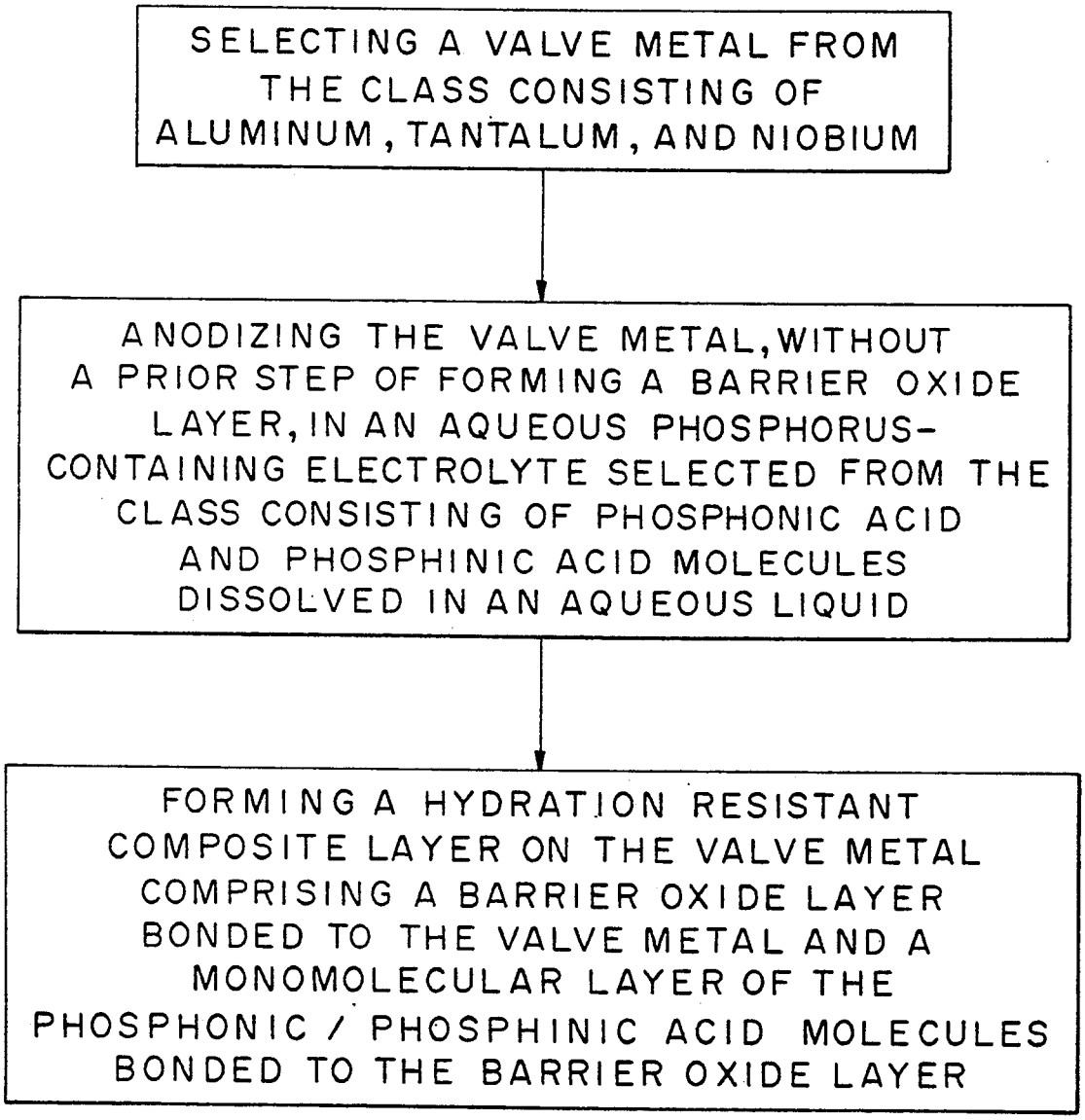
FIG. 4 is a flow sheet illustrating the process of the invention.

As shown in the graph of FIG. 3, the samples anodized in phenylphosphonic acid, in accordance with the invention, showed less weight loss, indicative of a denser oxide layer less subject to hydration and dissolution than the prior art tartaric acid-anodized samples. This hydration resistance may also be due to the increased hydrophobicity of the composite layer formed on the aluminum foil in accordance with the invention due to the presence of the organic groups in the functionalized layer formed over the barrier oxide layer. The resistance to hydration may also be due, in part, to the chemical nature of the aluminum phosphate present in the composite layer which provides a thermodynamically stable coating resistant to hydration even at elevated temperatures.

In any event, as is well known to those skilled in the art, a lack of resistance to hydration can result in a change of capacitance, due to the loss of crystallinity of the barrier oxide and the conversion of some of the oxide to hydroxide, resulting in loss of dielectric properties.

To further illustrate the differences between the improved composite layer electrolytic capacitor of the invention over capacitors formed in accordance with the prior art with respect to hydration resistance, one of the tartaric acid anodized samples, i.e., Sample 2 of Table II, anodized at 60 volts and at 20° C. and a sample anodized in accordance with the invention, i.e., Sample 8 in Table II, anodized at 60 volts in phenylphosphonic acid at 20° C., were immersed for 5 minutes in water heated to 100° C. The capacitance of each sample was then measured and compared to the initial capacitance recorded in Table II above. The capacitance of the Group 3 (prior art) sample was measured at 613 microfarad, indicating a change of 182%. In contrast, the capacitance of Sample 8 was 262 microfarad, indicating a decrease of less than 1%.

Thus, the invention provides, an improved electrolytic capacitor wherein the improvement comprises anodically forming a composite layer, including a dielectric oxide layer, on a valve metal surface, without prior formation of a thermal oxide layer thereon, in an aqueous phosphorus-containing organic acid electrolyte selected from the class consisting of phosphonic acid and phosphinic acid, to provide an electrolytic capacitor with a composite layer including a more dense barrier oxide dielectric layer having increased resistance to hydration and comparable capacitance to prior art electrolytic capacitors formed at the same voltage via the prior art two-step process in conventional electrolyte solutions.

Having thus described the invention, what is claimed is:

1. An improved electrolytic capacitor wherein the improvement comprises a composite of an organic layer and an oxide layer formed on aluminum, the composite having a phosphorous to aluminum ratio in the range of 0.001 to 0.1, the oxide layer located between the aluminum and the organic layer, the oxide layer and organic layer of a phosphorous-containing organic compound formed by contact of the aluminum with an aqueous phosphorous-containing organic electrolyte selected from the class consisting of phosphonic acid, phosphinic acid and mixtures of the same dissolved in an aqueous liquid.

2. The improved electrolytic capacitor of claim 1 wherein said composite comprises an oxide layer and an organic layer comprising the reaction products of said phosphonic acid or phosphinic acid with the aluminum.

3. The improved electrolytic capacitor of claim 2 wherein said oxide layer is bonded to said aluminum and said organic layer is bonded to said oxide layer.

4. The improved electrolytic capacitor of claim 3 wherein said organic layer comprises a monomolecular layer of said phosphonic acid or phosphinic acid reacted with said oxide layer.

5. The improved electrolytic capacitor of claim 3 wherein said oxide layer and said organic layer are formed by anodizing said aluminum in said aqueous phosphorus-containing organic electrolyte.

6. The improved electrolytic capacitor of claim 5 wherein said aluminum has a purity of at least about 99 wt. %.

7. The improved electrolytic capacitor of claim 5 wherein said aluminum has a purity of at least about 99.85 wt. %.

8. The improved electrolytic capacitor of claim 5 wherein the concentration of said phosphonic acid or phosphinic acid, dissolved in said electrolyte used to form said composite layer by anodizing said aluminum, comprises from about 0.1 to about 2 molar.

9. The improved electrolytic capacitor of claim 5 wherein the pH of said electrolyte used to form said composite layer ranges from about 1.0 to 12.

10. The improved electrolytic capacitor of claim 9 wherein said aqueous phosphorus-containing organic electrolyte used to form said composite layer comprises a monomeric phosphonic acid dissolved in an aqueous liquid.

11. The improved electrolytic capacitor of claim 10 wherein said phosphonic acid dissolved in said aqueous liquid used to form said composite layer comprises water soluble phosphonic acid having the formula $R_m[PO(OH)_2]_n$ wherein R is one or more organic radicals having a total of 1-30 carbons, m is the number of radicals in each molecule ranging from 1-10 and n is the number of phosphonic acid groups in each molecule ranging from 1-10.

12. The improved electrolytic capacitor of claim 11 wherein said phosphonic acid dissolved in said electrolyte used to form said composite layer comprises 1-12 carbon atom phosphonic acid.

13. The improved electrolytic capacitor of claim 11 wherein said R in said formula is selected from the group consisting of 1-18 carbon aliphatic hydrocarbons, aromatic hydrocarbons, carboxylic acids, aldehydes, ketones, amines, amides, thioamides, imides, lactams, anilines, pyridines, piperidines, carbohydrates, esters, lactones, ethers, alkenes, alkynes, alcohols, nitriles, oximes, organosilicones, ureas, thioureas, perfluoro organic groups, methacrylates and combination of these groups.

14. The improved electrolytic capacitor of claim 9 wherein said aqueous phosphorus-containing organic electrolyte used to form said composite layer, comprises a monomeric phosphinic acid dissolved in an aqueous liquid.

15. The improved electrolytic capacitor of claim 14 wherein said phosphinic acid dissolved in said aqueous liquid used to form said composite layer comprises water soluble phosphinic acid having the formula $R_mR'_o[PO(OH)]_n$ wherein R comprises one or more organic radicals having a total of 1-30 carbons, m is the number of R radicals in each molecule ranging from 1-10, R' comprises hydrogen or one or more organic radicals having a total of 1-30 carbons, o is the number of R' radicals ranging from 1-10 and n is the number of phosphinic acid groups in each molecule ranging from 1-10.

16. The improved electrolytic capacitor of claim 15 wherein said monomeric phosphinic acid dissolved in said electrolyte used to form said composite layer comprises 1-12 carbon atom phosphinic acid.

17. The improved electrolytic capacitor of claim 15 wherein said R or R' in said formula are selected from the group consisting of 1-18 carbon aliphatic hydrocarbons, aromatic hydrocarbons, carboxylic acids, aldehydes, ketones, amines, amides, thioamides, imides, lactams, anilines, pyridines, piperidines, carbohydrates, esters, lactones, ethers, alkenes, alkynes, alcohols, nitriles, oximes, organosilicones, ureas, thioureas, perfluoro organic groups, methacrylates and combinations of these groups.

18. In an improved electroyltic capacitor wherein the improvement comprises an organic layer and an oxide layer formed on aluminum, the oxide layer bonded to the aluminum and located between the aluminum and the organic layer of a phosphorous-containing organic compound, the layers formed by anodizing said aluminum in an aqueous electrolyte containing phosphonic acid, phosphonic acid and mixtures of the acids dissolved in an aqueous liquid, the improved electrolytic capacitor further characterized by the absence of a thermal oxide layer formed on said aluminum prior to anodizing the aluminum to form said layers.

19. An improved method of forming an electrolytic capacitor characterized by an improved resistance to hydration comprising:

(a) selecting a valve metal from the class consisting of aluminum, tantalum and niobium; and (b) anodizing said valve metal in an aqueous phosphorus-containing organic electrolyte selected from the class consisting of phosphonic acid, phosphinic acid and mixtures of the same dissolved in an aqueous liquid; to form a composite layer comprising a barrier oxide layer bonded to said valve metal and a layer of a phosphorus-containing organic compound bonded to said barrier oxide layer.

20. The improved method of forming an electrolytic capacitor of claim 19 which further comprises maintaining the concentration of said phosphonic acid or phosphinic acid, dissolved in said electrolyte used to form said composite layer by anodizing said valve metal, within a range of from about 0.1 to about 2 molar.

21. The improved method of forming an electrolytic capacitor of claim 19 which further comprises maintaining the pH of said electrolyte within a range of from about 1.0 to about 12.

22. The improved method of claim 21 wherein said anodizing step further comprises anodizing said valve metal in an electrolyte comprising an aqueous solution of phosphonic acid having the formula $R_m[PO(OH)_2]_n$ wherein R is one or more organic radicals having a total of 1-30 carbons, m is the number of radicals in each molecule ranging from 1-10 and n is the number of phosphonic acid groups in each molecule ranging from 1-10.

23. The improved method of claim 21 wherein said anodizing step further comprises anodizing said valve metal in an electrolyte comprising an aqueous solution of phosphinic acid molecules having the formula $R_mR'_o[PO(OH)]_n$ wherein R comprises one or more organic radicals having, a total of 1-30 carbons, m is the number of R radicals in each molecule ranging from 1-10, R' comprises hydrogen or one or more organic radicals having a total of 1-30 carbons, o is the number of R' radicals ranging from 1-10 and n is the number of phosphinic acid groups in each molecule ranging from 1-10.

* * * * *